United States Patent [19]

Yoda et al.

[11] Patent Number: 4,656,356

[45] Date of Patent: Apr. 7, 1987

[54] DEVICE FOR CHARGING ELECTROPHOTOGRAPHIC APPARATUS

[75] Inventors: Akira Yoda; Masamichi Sato; Shuichi Ohtsuka, all of Kanagawa, Japan

[73] Assignee: Fuji Photo Film Co., Ltd., Kanagawa, Japan

[21] Appl. No.: 546,920

[22] Filed: Oct. 31, 1983

[30] Foreign Application Priority Data

Oct. 30, 1982 [JP] Japan ..... 57-190942

[51] Int. Cl.[4] ..... G03G 15/02

[52] U.S. Cl. ..... 250/326; 250/324

[58] Field of Search ..... 250/325, 326, 324; 361/230; 355/3 CH

[56] References Cited

U.S. PATENT DOCUMENTS 3,656,021 4/1972 Furuichi et al. ..... 250/326 X 4,320,956 3/1982 Nishikawa et al. ..... 250/324

4,437,001 3/1984 Harada ..... 250/326 X

*Primary Examiner*—Alfred E. Smith

*Assistant Examiner*—Jack I. Berman

[57] ABSTRACT

A charging device for use in an electrophotographic apparatus is disclosed which charges, with improved efficiency and uniformity, a limited area of an electrophotosensitive member where a picture image is to be formed by corona discharge and which uniformly distributes electrostatic charges over the entire surface of the above area of the electrophotosensitive member. In the device, conductive members are disposed on both sides of a corona wire in the charging chamber to act as mating electrodes, and a mask in the form of a flexible film projects toward the opening of the chamber in such a manner as to make intimate contact with the electrophotosensitive member during charging.

6 Claims, 13 Drawing Figures

DEVICE FOR CHARGING ELECTROPHOTOGRAPHIC APPARATUS

BACKGROUND OF THE INVENTION

This invention relates to a charging device for use in an electrophotographic apparatus, and more particularly to a charging device which charges, with improved efficiency and uniformity, a predetermined limited area of an electrophotosensitive member by corona discharge where a picture image is to be formed. It also relates to a charging device in which, for the purpose of preventing a fogging phenomenon and an excessive increase in picture image density during development due to an excessively high density distribution of electrostatic charges in an area adjacent to the predetermined limited area of the electrophotosensitive member as well as preventing a non-developing phenomenon or an excessive decrease in picture image density during development due to an excessively low density distribution of electrostatic charges, means are provided so that electrostatic charges can be uniformly distributed over the predetermined limited area of the electrophotosensitive member.

As is well known, electrophotography comprises electrostatically charging a photoconductive insulating layer of an electrophotographic film, exposing the charged area to form an electrostatic latent image of a picture image, applying a toner to the electrostatic latent image for positive or reversal development, and fixing the toner for recording the picture image. It has, therefore, an advantage over the conventional photography using a film of silver-halide photosensitive material in that the photosensitivity does not appear before the electrophotographic film is charged. For this reason, the electrophotography finds various useful applications in various fields. For example, in the field of microfilm recording, a film formed by laminating a photoconductive transparent insulating layer on a conductive support is used as an electrophotosensitive member, and a picture image is recorded on a predetermined area of the film by the steps of charging, exposing, developing and fixing. The picture image thus formed is then, for example, projected together with non-recorded areas of the film, and, when so required, a new picture image is subsequently additionally recorded on a non-recorded area of the film. This manner of picture image recording has made possible useful utilization of microfilms for applications which were not possible with the conventional silver-halide photography.

An electrophotographic apparatus comprises charging, exposure, developing and fixing devices. In order to obtain better image quality, it is essential that the entire image frame area of the electrophotosensitive member be uniformly charged. However, this has not been so very easy because, on one hand, corona discharge is generally used for charging by the charging device, and, on the other hand, it has been conventional in the process of microfilm preparation to charge only a predetermined desired area of the electrophotosensitive member without changing the relative positions of the electrophotographic member and the charging device. The charging efficiency has also been unsatisfactory because only a very limited proportion of ions generated by corona discharge could be utilized. It is, therefore, an object of the present invention to provide a charging device which achieves uniform charging and uniform distribution of electrostatic charges over the entirety of the predetermined area of the electrophotosensitive member with improved efficiency.

Before describing the present invention in detail, a charging device commonly used heretofore in the art will be described with reference to FIG. 1. In the drawing, a corona wire 1 is encased in a shielding casing 2 of U-shaped cross section formed of a metal plate in view of the necessity for application of a high electric field for generating corona ions. This shielding casing 2 is grounded to act as a mating electrode disposed opposite the corona wire 1 for generating corona ions, and a high voltage is applied across the corona wire 1. The high electric field thus established causes ionization of the atomosphere near the corona wire 1 so that corona discharge occurs between the corona wire 1 and the shielding casing 2. A portion of the corona ions leak outside from an opening 2*a* of the shielding casing 2 and impinge against that portion of a film 3 which faces the opening 2*a* thereby charging this film portion. Since the shielding casing 2 terminates close to the film 3, however, a substantial portion of the corona ions are absorbed by the shielding casing 2 before they reach the opening 2*a*, leaving a very small amount of ions to be discharged from the opening 2*a*, resulting in a low charging efficiency.

Therefore, a high-voltage power source having a large capacity is required. Moreover, an electric force acts upon the corona ions migrating through the opening 2*a* toward the film 3 thereby attracting the corona ion toward the marginal edge of the opening 2*a* of the shielding casing 2 grounded to act as the mating electrode, and, consequently, the density of corona ions impinging against the film 3 becomes non-uniform, resulting in non-uniform charging.

It should be noted, however, that such non-uniform distribution of the corona ions has posed no problem in the conventional copiers and like machines because the electrophotosensitive member and the corona charging device have relative velocities.

As one of means for attaining uniform charging, a charging device has been proposed to in which a conductive member provided on the peripheral edge of the opening 2*a* is connected with an external bias power source or grounded via a resistor having a high resistance so as to apply a bias potential which is substantially equivalent to the charged potential of the electrophotosensitive member, thereby correcting the electric field distribution in the vicinity of the opening 2*a*. The proposed device is effective in correcting non-uniform charging due to the electric field disturbance caused by the lower end of the shielding casing around the opening 2*a* and is particularly effective in correcting non-uniform charging along the longitudinal edges of the corona wire. This device, however, is not satisfactory as it causes non-uniform charging in the direction perpendicular to the corona wire when the device is used to uniformly charge a very limited narrow area of a microfilm for formation of a picture image thereon, under the conditon in which the electrophotosensitive member and the charging section are stationary relative to each other. It also causes non-uniform charging as described above when the distance between the corona wire and the electrophotosensitive member is limited to be almost equivalent to the width of the opening due to the limitation in space. This device is further defective in that the amount of charges at the peripheral portion of a picture image area becomes less than that at the central portion thereof because the distance from the corona wire differs depending on the central and peripheral portions of the image area. This device is also defective in that it is extremely difficult to apply a bias potential required for complete charging under the condition in which the potential of the electrophotosensitive member and that at the periphery of the opening become substantially the same, because the potential at the periphery of the opening rises shortly after it is charged, thereby giving rise to a gap between it and the potential of the electrophotographic member of the potential of the electrophotosensitive member becomes high than that at the periphery of the opening in a certain time.

A charging device has been disclosed in U.S. Pat. No. 3,991,311 which attempts to overcome the problems caused by the non-coincidence between the rate of increase in the surface potential of the electrophotosensitive member and the rate of increase in the periphery potential of the opening and to control the latter potential at a desired level by connecting a capacitor or the like to the conductive member so that the potential applied to the conductive member can vary with the progress of the process of charging. But this device is also defective in that difficulty is encountered in setting the capacitance of the capacitor suitable for a particular electrophotosensitive member and that it gives rise to an increase in the cost. The inventors, therefore, have made researches and studies to find out a best form of the mating or grounded electrode for generating corona ions to attain uniform charging and found that the shielding casing is preferably replaced by a mating electrode formed of a thin conductive member in wire- or sheet-like form, and this electrode is grounded to provide a greater potential difference between it and the corona wire. In order to prevent a fogging phenomenon or an excessive increase in picture image density during development due to excessively densely distributed electrostatic charges and also preventing an image-missing phenomenon or an excessive decrease in picture image density during development due to excessively thinly distributed electrostatic charges during electrostatic charging with corona discharge, a mask in the form of a film is preferably provided on the electrophotosensitive-member side of the opening in a relation making intimate contact with or closely adjacent to the electrophotosensitive member. It would be further effective when another conductive member is provided on the peripheral edge of the opening and a grounded resistor havig a high resistance is connected to this conductive member, thereby applying an auxiliary bias potential to the conductive member.

SUMMARY OF THE INVENTION

In view of the circumstances described above, the present invention contemplates to provide a charging device for use in an electrophotographic apparatus which is simple in construction, improves the efficiency and uniformity of charging and is capable of uniformly charging the entire area of an image frame of an electrophotosensitive member where a picture image is to be formed. The present invention is characterized in that:

(1) in a charging member containing a corona wire for electrostatically charging an electrophotographic member, thin conductive members are provided on both sides of the corona wire in parallel with the surface of the electrophotosensitive member in a plane including substantially the axis of the corona wire, the conductive members acting as mating electrodes for generating corona ions; and (2) in a charging chamber containing a corona wire for electrostatically charging an electrophotographic member, a film mask projects toward the opening of the charging chamber, the mask being arranged to make intimate contact with or to be located closely adjacent to the electrophotosensitive member during charging.

DETAILED DESCRIPTION OF THE PREFERRED EMBODIMENTS

Figure 2A:
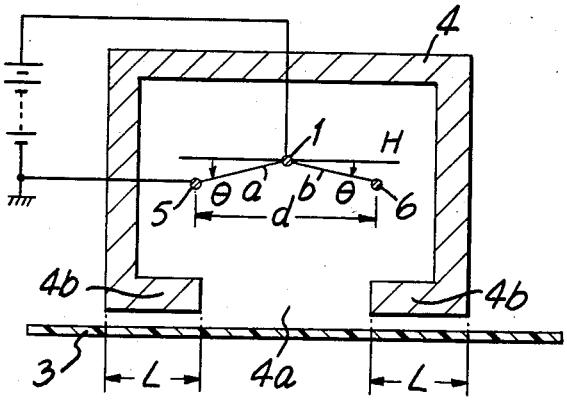
FIGS. 2(*a*) and 2(*b*) are sectional view of embodiments of the charging device according to the present invention, wherein FIG. 2(*a*) shows the case where a non-picture-image forming part L is formed around the opening, and FIG. 2(*b*) shows the case where the succeeding processing sections are integrally formed with the charging section.
Figure 2B:
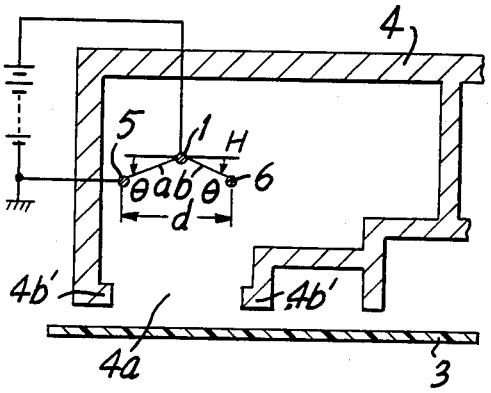

The present invention will now be described in detail referring to the accompanying drawings which show preferred embodiments of the charging device for electrophotographic apparatus. FIGS. 2(*a*) and (*b*) show embodiments of the charging device in sectional view wherein the reference numeral 4 denotes a charging chamber whose inner wall is at least formed of an insulating material. A corona wire 1 extends in parallel with the surface of an electrophotographic film 3 and opposite the center of an opening 4*a* of the chamber 4, this opening 4*a* being located on the side where the film 3 passes. Two thin wires 5 and 6 are provided on both sides of the corona wire 1 in symmetry with each other and also in parallel with the surface of the film 3 in a plane H including substantially the axis of the corona wire 1 to act as mating electrodes which are grounded. In FIG. 2(*a*), the peripheral portion of the opening 4*a* of the charging chamber 4 constitutes a charging-inhibiting projection 4*b* providing a non-picture-image forming part L thereby defining a charge area. FIG. 2(*b*) is a sectional view of a process head which integrally houses various processing sections to meet the requirements in space that a charging section, an exposure section, a development section, a drying section and fixing section are to be continuously provided in order to record a large number of picture images sequentially and continuously on one frame after another of the electrophotographic film 3.

Figure 1:
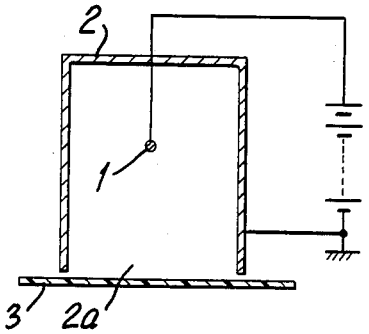
FIG. 1 PRIOR ART
FIG. 1 is a sectional view of a conventional charging device.

Corona ions are generated in response to a high voltage applied across the corona wire 1 and the mating or grounded electrodes 5 and 6. Because the electrodes 5 and 6 are in the form of the thin wire, their surface area is extremely small when viewed from the corona wire 1, and consequently the amount of corona ions absorbed by the electrodes 5 and 6 is much less than in the case of FIG. 1. Therefore, a large amount of corona ions migrates toward the film 3 through the opening 4*a*. The corona ion density becomes substantially uniform over the entire surface of the film 3 thereby uniformly charging the film 3 because the chamber 4 does not act as an electrode and thus there is nothing, in the area beneath the electrodes 5 and 6 and near the opening 4*a*, which produces an electric force causing absorption of the corona ions.

Figure 3:
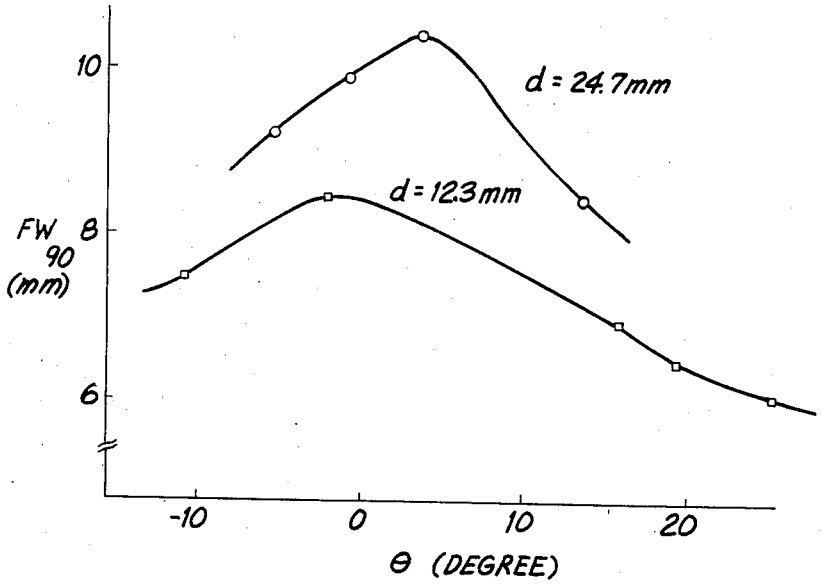
FIG. 3 is a graph showing the relation between the relative positions of the corona wire and the mating electrodes and the uniformity of electrostatic charging.
Figure 4:
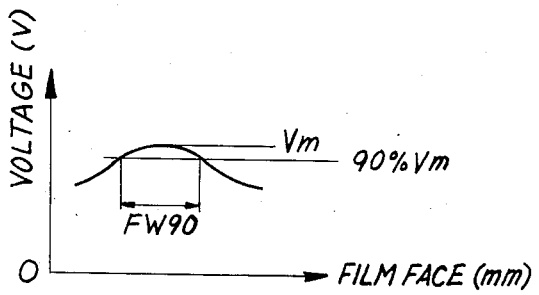
FIG. 4 illustrates how the uniformity of electrostatic charging is evaluated.

Efficient and uniform electrostatic charging depends somewhat on the positional relation between the corona wire 1 and the grounded electrodes 5 and 6. Qualitatively, the efficiency is improved when the electrodes 5 and 6 are located nearer to the film 3 because corona ions are attracted more toward and onto the film 3; on the other hand, the uniformity is improved when the electrodes 5 and 6 are positioned farther from the film 3. The present inventors then studied the mode of the electrostatic charges on the film 3 while varying the positions of the electrodes 5 and 6 relative to the corona wire 1. The result is shown in FIG. 3. The distance d between the two electrodes 5 and 6 was set at d=12.3 mm and d=24.7 mm respectively, and the angle $\theta$ formed between the lines a and b connecting the corona wire 1 with the centers of respective electrodes 5 and 6 and the plane H parallel to the film 3 and including the axis of the corona wire 1 is selected as a variable. The length $FW_{90}$ of the area where the potential becomes greater than 90% of the maximum potential Vm was sought by measuring the potential distribution on the film 3 as shown in FIG. 4. It is supposed that the angle $\theta$ is positive when the grounded electrodes 5 and 6 are located beneath the plane H and negative when they are located above the plane H. The distance between the corona wire 1 and the film 3 was 14 mm.

It can be seen from FIG. 3 that, with $\theta \approx 0$, or when the grounded electrodes 5 and 6 are located very close to the plane H which includes the axis of the corona wire 1, the electrostatic charges are most uniformly distributed. It is also noted, that this uniform charge distribution can be attained over a considerably wide range, even when the angle $\theta$ increases slightly in the positive direction.

Figure 5A:
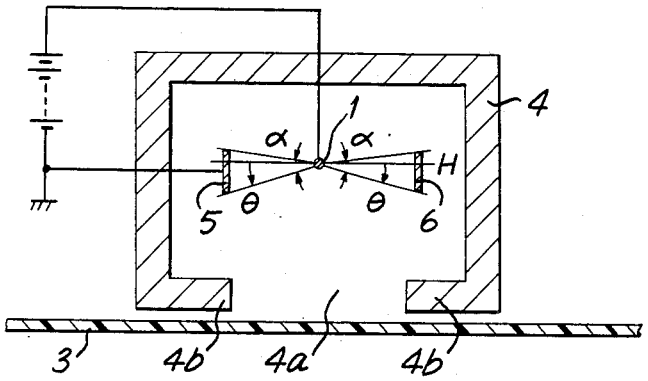
FIGS. 5(*a*) and (*b*) are sectional view of modifications of the device shown in FIGS. 2(*a*) and 2(*b*), wherein FIG. 5(*a*) shows the case in which the mating electrodes are in the form of plates, and FIG. 5(*b*) the case in which the mating electrodes are in the form of plates and there is further provided another conductive member.
Figure 5B:
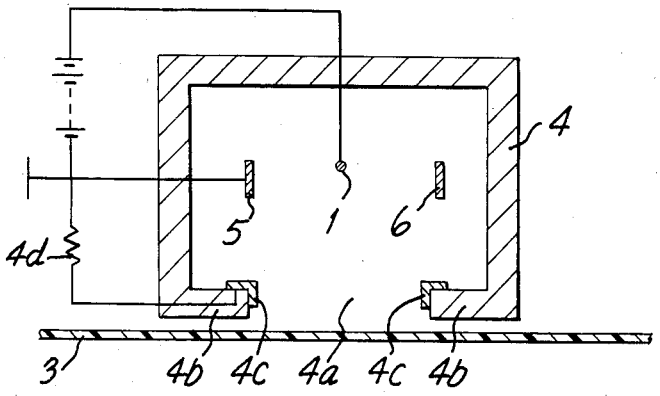

In FIGS. 2(*a*) and 2(*b*), thin wires are used as grounded electrodes 5 and 6. However, electrodes in the form of a plate as shown in FIG. 5(*a*) can also be used to attain sufficiently uniform distribution of electrostatic charges when the angle $\theta$ defined between the aforementioned plane H and the line connecting the bottom of the electrodes with the corona wire 1 is maintained within the range of from 20° to 30°. It should be noted, however, that if the upper ends of the plate electrodes should extend too far upward, a considerable amount of corona ions would be absorbed by those extensions. It is, therefore, preferable that the thickness of the plates be as thin as possible when the electrodes 5 and 6 are in the plate form and, the diameter of the wires be as small as possible when the electrodes are in the wire form, such that the subtending angle $\alpha$ of the plates or wires with respect to the corona wire 1 is less than 10°. The angle $\theta$ made between the plates or wires and the aforementioned plane H is preferably ±30° or less and, more preferably, ±10° or less.

As for the charging chamber 4 which encloses the corona wire 1 and the grounded electrodes 5 and 6, the chamber 4 itself does not act as an electrode; however, since the corona ions may also impinge against the chamber to impart it with a certain potential and somewhat affect the uniform distribution of the electrostatic charges on the film 3, it is necessary to design the charging chamber so that the inner wall thereof is spaced apart as much as possible from the grounded electrodes 5 and 6.

Figure 6:
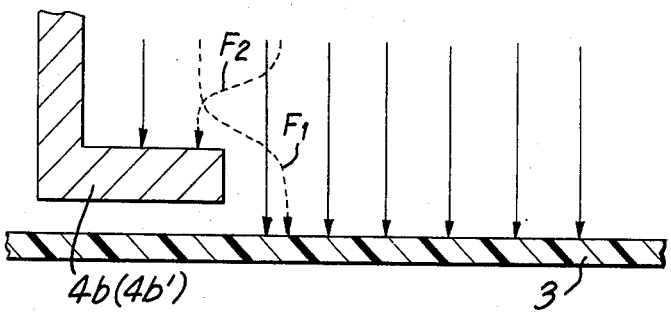
FIG. 6 is an explanatory view to illustrate the lines of corona discharge during charging.
Figure 7A:
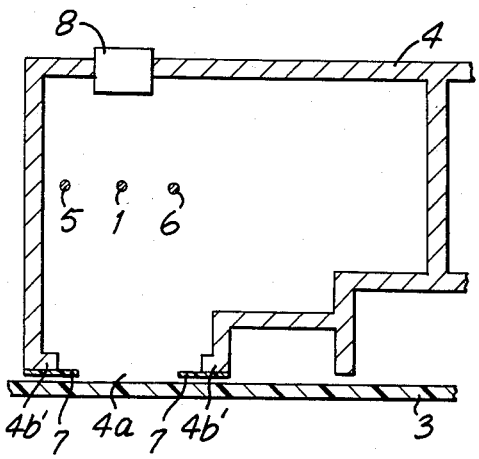
FIGS. 7(*a*), 7(*b*) and 7(*c*) are sectional views to show further embodiments of the present invention.
Figure 7B:
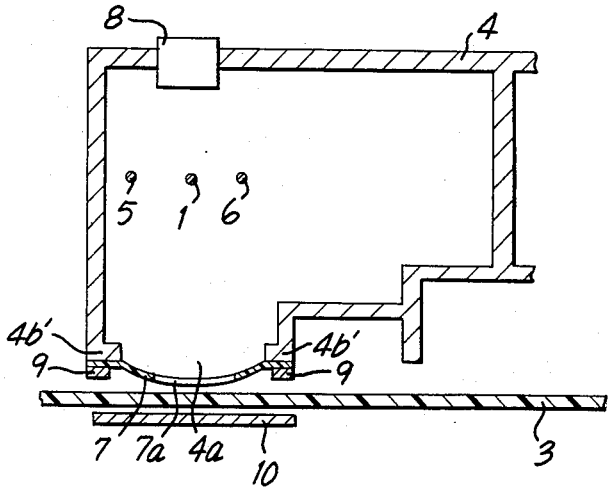
Figure 7C:
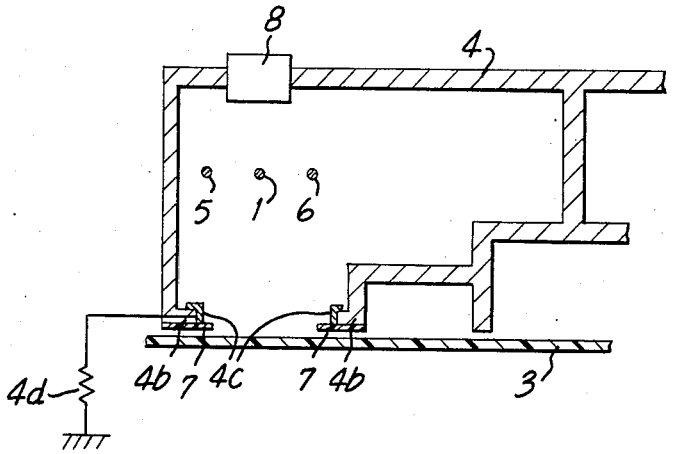

If there is no projection 4*b* at the opening 4*a* of the charging chamber 4, the migrating corona ions would impinge against that area of the electrophotographic film 3 where the picture image is to be formed thereby uniformly charging this area as indicated by the solid lines in FIG. 6. On the other hand, the presence of the projection 4*b*, if it is formed of an insulating material, would create an electric field $F_1$ directed toward the electrophotosensitive surface and thereby cause fogging or an excessive increase in picture image density during development around the picture frame area due to the excessively densely distributed electrostatic charges. Moreover, if the electric field $F_1$ is substantial, the charges would be concentrated at the central portion of the electrophotosensitive surface thereby narrowing the charged area. In the case where the projection 4*b* is formed of a conductive material and grounded, it would create an electric field $F_2$ directed toward the projection and thereby cause image-missing around the picture frame area of the electrophotosensitive surface, which will lower the image quality due to the excessively low density distribution of electrostatic charges. In order to overcome these defects, the present invention employs a mask 7 in the form of the flexible film projecting into the opening 4*a* from the lower end of the projection 4*b* facing the electrophotographic film 3, as shown in FIG. 7(*a*). During charging, the mask 7 is brought into intimate contact with the electrophotographic film 3. The thin mask 7 prevents the electrophotosensitive surface of the film 3 from being affected by the potential inside the opening 4*a*, whereby uniform charging can be attained especially at the periphery of the picture image area. When a large number of picture images must be recorded on one frame after another of the electrophotographic film 3 sequentially and continuously at a high processing speed in a limited space, it is more effective to effect the steps of charging and exposing at the same opening 4*a*. For such a purpose, a lens 8 for exposure is provided at the charging section as shown in FIG. 7(*a*).

Figure 8A:
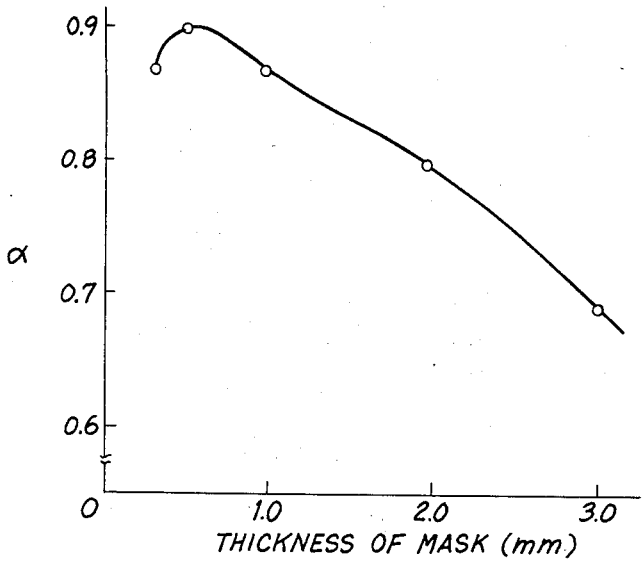
FIGS. 8(*a*) and (*b*) show the effect of the present invention, wherein FIG. 8(*a*) is a graph, and FIG. 8(*b*) is a voltage curve showing the voltage applied to the electrophotosensitive member by corona discharge.
Figure 8B:
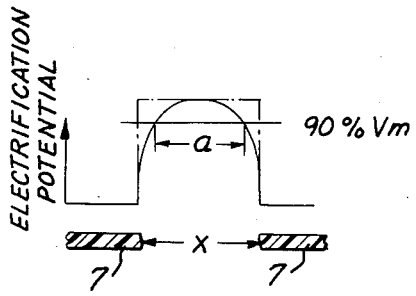

An insulating material such as celluloid, vinyl chloride, PET, or the like can be used as the material of the masking film 7. It is empirically proven that the thinner the masking film 7, the less is the potential rise. In other words, while the electrophotosensitive surface of the film 3 is charged by the corona discharge along a voltage curve as shown by the solid line in FIG. 8(*b*), ideally it is necessary that the charging should occur along a curve, as shown by the one-dot chain line in FIG. 8(*b*), in order that the charges can be distributed uniformly over the entire area of a single frame on the electrophotosensitive surface. a/x (=$\alpha$) is measured where x denotes the distance between the opposing ends of the masking film 7 and a denotes the distance on the curve where the voltage assumes a value greater than 90% Vm. Then FIG. 8(*a*) indicates that the thickness of the mask 7 of celluloid should be less than 2.0 mm if the condition of $\alpha \geqq 0.8$ is to be satisfied. This leads to the conclusion that the thin film mask 7 projecting at the opening 4*a* of the charging chamber 4 reduces the influence of the potential of the mask 7 on the electrophotographic film 3, and they are maintained at substantially the same potential which is approximately ideal as shown by the one-dot chain line in FIG. 8(*b*).

It has been also found that the mask 7 should preferably project as much as possible toward the opening 4*a* while maintaining the distance between the mask 7 and the electrophotographic film 3 as short as possible during charging; in this way, more uniform distribution of the electrostatic charges can be achieved. The projecting length of the mask 7 should preferably be longer than 1.5 times as large as the thickness of the mask 7, and the mask 7 and the electrophotographic film 3 are preferably brought in complete intimate contact during charging. When complete intimate contact therebetween is not obtainable because of various factors including the optical system, the mask 7 should be so arranged that its surface facing the charging chamber 4 should not be spaced by more than 2.0 mm from the electrophotosensitive surface of the film 3.

FIG. 7(*b*) shows a modification of the embodiment shown in FIG. 7(*a*). The mask 7 has an opening 7*a* which corresponds to one frame of the electrophotographic film 3. The mask 7 is bent toward the electrophotographic film 3 with at least one of the both ends thereof being fixed to the projection 4*b*. A stopper 9 is affixed to the projection 4*b*, and a pressure plate 10 is provided beneath the electrophotographic film 3 to move upward at the time of charging and exposing. As the pressure plate 10 moves upward at the time of charging and exposing, the electrophotographic film 3 is pressed upward to abut the mask 7. The stopper 9 restricts the upward movement of the pressure plate 10 by abutting with the stopper 9 via the electrophotographic film 3. The mask 7 contracts as it is abutted by the electrophotographic film 3. The contraction is either absorbed by the flexibility of the mask 7 itself or by a slight displacement thereof when one end is made free. Then, as soon as the mask 7 and the electrophotographic film 3 are brought into close contact, the electrophotographic film 3 is electrostatically charged, and then exposed by means of the lens 8. During these steps, the electrophotographic film 3 is kept pressed by the pressure plate 10, which in turn is held in place by the stopper 9. Thus, the electrophotographic film 3 is always spaced apart from the lens 8 by a constant distance to achieve better exposure. It is noted that the interval between the electrophotographic film 3 and the lens 8 must be set at a precision of several tens of μm to have an accurate focus. Voltage is applied to the wire 1 for electrostatically charging the electrophotosensitive surface of the film 3 by corona discharge when the mask 7 and the electrophotographic film 3 come into intimate contact. During charging, the mask 7 and the electrophotographic film 3 should be retained in such a way that no relative velocity exists therebetween. In the charging device which effects charging and exposure at the same opening 4*a*, it is preferable to electrically insolate the lens 8 from the electric system so as to prevent discharge from the corona wire I toward the lens 8.

In order to further enhance the effect of this invention, a conductive member 4*c* may be provided on the periphery of the opening 4*a* of the charging chamber 4, and auxiliary means may also be provided to apply the conductive member 4*c* with a potential which is substantially equivalent to the potential applied to the electrophotographic film 3 as shown in FIGS. 5(*b*) and 7(*c*). This is especially effective in the case where the projecting length of the film mask 7 according to this invention cannot be made so large. As the aforementioned auxiliary means which applies the potential above described, the conductive member 4*c* provided on the periphery of the opening 4*a* of the chamber 4 may be grounded via a resistor 4*d* having high resistance. The resistance of this resistor 4*d*, therefore, may be selected so that the bias potential attains about 80 to 120% of that of the electrophotographic film 3. The practical value of such a resistance may be several GΩ generally although it varies depending on the potential and property of the electrophotographic film 3 or the surface area of the conductive member 4*c*. The conductive member 4*c* may be made of such a metal as copper, aluminum or stainless steel, or of a metal oxide. Alternatively, a conductive paint may be coated to provide the conductive member 4*c*.

As described in the foregoing, according to this invention, uniform electrostatic charging can be effected over the entire area of a picture image frame, by virtue of the provision of the film mask 7 which acts to distribute electrostatic charges uniformly especially at the periphery of the picture image frame, together with the provision of the conductive member 4*c* to which a potential substantially equivalent to the surface potential of the electrophotographic film 3 is applied.

In a charging device which is not provided with a film mask 7 as shown in FIG. 5(*b*), it is essential to arrange the conductive member 4*c* in a position slightly apart from the electrophotographic film 3 so that the former may not contact the latter.

As has been described in detail in the foregoing with respect to the preferred embodiments shown in the drawings, the charging device according to the present invention is capable of efficient and uniform electrostatic charging because relatively thin grounded electrodes are disposed opposite to each other on both sides of the corona wires and because the shielding casing does not act as a mating grounded electrode. Thin film masking means is provided to project into the opening of the charging chamber, and this masking means and the electrophotographic film are arranged so as to be brought into close contact with each other at the time of charging. This simple construction can effectively distribute the electrostatic charges uniformly over the electrophotosensitive surface of the electrophotographic film.

We claim:

1. A charging device for an electrophotographic apparatus comprising a corona wire disposed in a charging chamber in parallel relation with an electrophotographic film and opposite the center of an opening of said chamber to electrostatically charge in a stationary state the electrophotosensitive surface of said film, a pair of electrodes disposed in parallel with both the surface of said electrophotographic film and on both sides of said corona wire in a plane substantially coextensive with the axis of said corona wire, said electrodes being so disposed that an imaginary line connecting their lower portions with said corona wire makes an angle of ±30° or less with respect to a plane containing said corona wire, and a subtending angle defined between the lower portions of the electrodes, the upper portions of the electrodes and the corona wire is less than about 10°; said electrodes being grounded and cooperating with said corona wire for generating corona ions, electrically insulating means projecting inwardly of said opening and facing said electrophotosensitive film so that said insulating means can be brought substantially in contact with said electrophotosensitive film during charging; the inner periphery of the opening of said charging chamber being provided with a conductive member thereby facilitating application of a bias potential to said conductive member which is substantially equivalent to the surface potential of said electrophotographic film.

2. A charging device for an electrophotographic apparatus as claimed in claim 1, wherein said electrodes are each in the form of a thin wire.

3. A charging device for an electrophotographic apparatus as claimed in claim 1, wherein said electrodes are each in the form of a thin plate.

4. A charging device for an electrophotographic apparatus as claimed in claim 1, wherein said conductive member is grounded via a resistor.

5. A charging device for an electrophotographic apparatus as claimed in claim 1, wherein said inwardly projecting insulating means projects at a distance of at least 1.5 times the thickness thereof and is spaced apart by a distance of less than 2.0 mm from the surface of said electrophotographic film.

6. A charging device for an electrophotographic apparatus as claimed in claim 1, further comprising means for pressing said electrophotographic film toward said inwardly projecting insulating means during charging to bring said electrophotographic film into intimate contact with said insulating means.

* * * * *